US009739003B2

(12) United States Patent
Carr et al.

(10) Patent No.: US 9,739,003 B2
(45) Date of Patent: Aug. 22, 2017

(54) HYBRID LAUNDRY MOVER

(71) Applicant: Whirlpool Corporation, Benton Harbor, MI (US)

(72) Inventors: David W. Carr, Saint Joseph, MI (US); John W. McConnell, Saint Joseph, MI (US); Basak Oguz, Saint Joseph, MI (US); Jon D. Strait, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 600 days.

(21) Appl. No.: 13/928,698

(22) Filed: Jun. 27, 2013

(65) Prior Publication Data

US 2015/0000352 A1 Jan. 1, 2015

(51) Int. Cl.
*D06F 17/10* (2006.01)

(52) U.S. Cl.
CPC ..... *D06F 17/10* (2013.01)

(58) Field of Classification Search
CPC ..... D06F 13/00; D06F 13/02; D06F 13/04; D06F 13/06; D06F 13/08; D06F 17/06; D06F 17/08; D06F 17/10
See application file for complete search history.

(56) References Cited

U.S. PATENT DOCUMENTS 2,199,027 A * 4/1940 Litle, Jr. ..... D06F 13/00 416/241 A
2,318,759 A * 5/1943 Crimmel ..... D06F 13/00 68/133
2,356,312 A * 8/1944 Gerhardt ..... D06F 13/00 68/134
2,565,056 A * 8/1951 Whitlock ..... D06F 13/00 68/133
7,392,672 B2 7/2008 Kim et al.
2005/0284197 A1* 12/2005 Pinkowski ..... D06F 13/02 68/133
2006/0162395 A1* 7/2006 La Belle ..... D06F 13/02 68/133
2011/0030425 A1 2/2011 Kim et al.

FOREIGN PATENT DOCUMENTS

| | | | |
|---|---|---|---|
| CN | 2318243 | Y | 5/1999 |
| CN | 2464756 | Y | 12/2001 |
| CN | 2612692 | Y | 4/2004 |
| CN | 201121261 | Y | 9/2008 |
| CN | 202359385 | U | 8/2012 |
| JP | 7163778 | A | 6/1995 |
| TW | 125593 | S | 10/2008 |
| TW | 125594 | S | 10/2008 |

* cited by examiner

*Primary Examiner* — David Cormier

(57) ABSTRACT

A laundry treating appliance may include a treating chamber receiving laundry for treatment and a laundry mover mounted within the treating chamber for rotation about a rotation axis. The laundry mover may have a base made of a first material and a plurality of protrusions made of a different second material. At least portions of the upper surfaces of the base and the protrusions collectively form an upper surface of the laundry mover such that the laundry mover upper surface is at least partially formed of the differing first and second materials. The first material may be metal, and the second material may be plastic.

19 Claims, 12 Drawing Sheets

HYBRID LAUNDRY MOVER

BACKGROUND

Some laundry treating appliances, such as washing machines, include a laundry mover rotatable within a basket during the treating of laundry to facilitate movement of liquid and/or laundry in the basket. Examples of laundry movers include, but are not limited to, impellers and agitators. It is common in the laundry treating art for current impellers to have a plastic base that is completely overlaid with a metal cover.

SUMMARY

A laundry treating appliance according to one embodiment configured to treat laundry according to an automatic cycle of operation may comprise a treating chamber receiving laundry for treatment and a laundry mover mounted within the treating chamber for rotation about a rotation axis. The laundry mover may include a base having an upper surface and made of a first material and a plurality of protrusions having an upper surface extending upwardly from the base and made of a second material different from the first material. At least portions of the upper surfaces of the base and the protrusions may collectively form an upper surface of the laundry mover such that the laundry mover upper surface is at least partially formed of the differing first and second materials.

DETAILED DESCRIPTION

Figure 1:
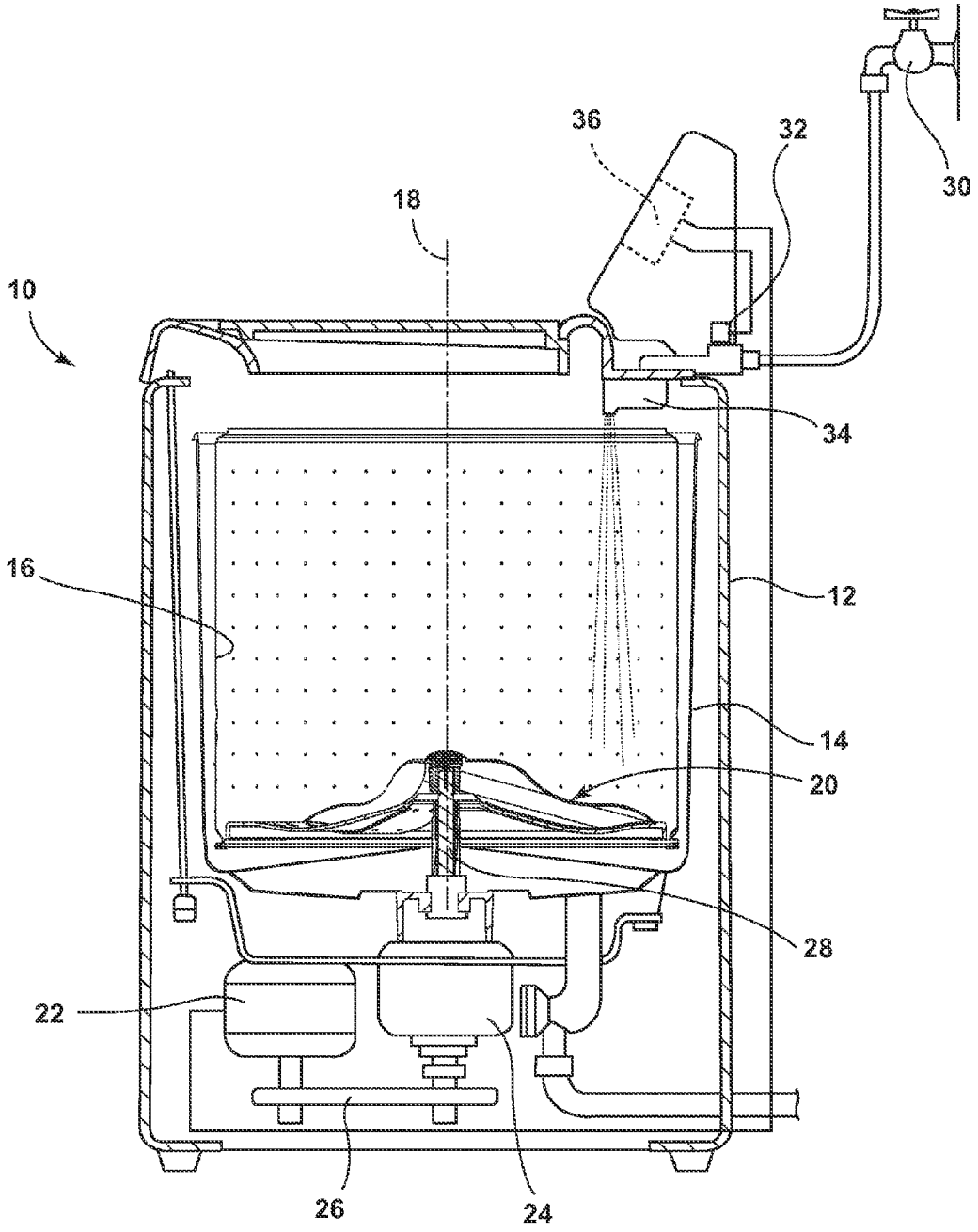
FIG. 1 is a schematic sectional view of a fabric treating appliance in the form of a washing machine having a laundry mover in the form of an impeller according to one embodiment.

Automatic washing machines may typically comprise a perforated basket or drum for holding a laundry load, which may include garments, sheets, towels, and other fabric items, and an imperforate tub containing a liquid typically comprising water or a mixture of water and detergent or other treatment aid. A laundry mover may be rotationally, generally coaxially, mounted in the bottom of the basket and adapted for angular oscillation in order to agitate the laundry load. In one configuration, the basket, the laundry mover, and the tub may be oriented about a vertical axis.

Traditionally, a vertical axis laundry mover may be configured as an impeller or an agitator. The impeller is typically a low-profile base element having a circular periphery, with protrusions extending upward from the base element. The agitator typically has a base, which may be in combination with an auger that extends along the vertical axis approximately the height of the tub.

It is generally understood that a deep fill wash cycle, typically associated with an agitator, refers to a cloth to liquid ratio that, when combined with the action of the laundry mover, produces fluid motion which significantly aids in the motion of the laundry items even if the actual liquid level in the machine is not near the top of the basket. The laundry is considered suspended in the free fluid, or submerged, when there is sufficient fluid power to directly result in movement of the laundry. The combination of the agitator contacting the laundry, the liquid moving through the laundry, and the relative contact between the laundry items imparts mechanical energy to the laundry for cleaning.

Likewise, a low fill wash cycle, also called a low water wash cycle and typically associated with an impeller, generally refers to a cloth to liquid ratio that, when combined with the action of the laundry mover, produces insufficient fluid motion to directly result in cloth motion regardless of the direction of fluid motion. In fact, the resulting cloth motion may still be present even if very little free fluid is present. In this process, a laundry item is not considered to be suspended or submerged in the free liquid even if the actual liquid level is near the top of the basket or near the top of the laundry load. The mechanical energy for cleaning the laundry in the low water wash comes from the interaction between the laundry items.

In a vertical axis washing machine with a deep fill wash cycle where the laundry is completely submerged, reciprocal movement of an agitator moves the laundry items along a toroidal, or donut-shaped, path extending radially inwardly toward the center of the basket, downwardly along the vertical axis, radially outwardly toward the outer wall of the basket, and upwardly along the perimeter of the basket where they repeat the cycle. One full cycle along this path is commonly referred to as a "rollover."

In a low water cycle, such as where the laundry items are wetted but not submerged, the movement of the laundry items by reciprocating the impeller moves the laundry items in an opposite direction than that of the agitator with a deep fill in what has been termed an "inverse toroidal rollover." The inverse toroidal rollover typically moves the laundry items along a path extending radially outwardly toward the outer wall of the basket, downwardly along the perimeter of the basket, radially inwardly toward the center of the basket, and upwardly along the vertical axis where they repeat the cycle.

The present invention is directed to a laundry mover, such as an impeller, agitator, combination impeller and agitator, or other type of laundry mover. FIG. 1 is a schematic view of a laundry treating appliance according to an exemplary embodiment. The laundry treating appliance may be any appliance that performs a cycle of operation to clean or otherwise treat items placed therein, non-limiting examples of which include a horizontal or vertical axis clothes washing machine; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 that defines a housing within which a laundry holding system resides. The cabinet 12 may be a housing having a chassis and/or a frame, defining an interior receiving components typically found in a conventional washing machine, such as motors, pumps, fluid lines, controls, sensors, transducers, and the like. Such components will not be described further herein except as necessary for a complete understanding of the invention.

The illustrated exemplary washing machine 10 may include a watertight tub 14 installed in the cabinet 12. A perforated basket 16 at least partially defining a treating chamber receiving a load of laundry items may be mounted in the tub 14 for rotation about an axis of rotation, such as, for example, a central, vertical axis 18 extending through the center of a laundry mover in the form of an impeller 20, which will be described in further detail below, mounted in the treating chamber. A drive motor 22 operating a transmission 24 through a drive belt 26 may be utilized to rotate the basket 16 and the impeller 20. The impeller 20 may be positioned above the floor of the basket 16 and rotated by a drive shaft 28 extending through an opening in the floor of the basket 16. The illustrated drive system for the basket 16 and the impeller 20 is provided for exemplary purposes only and is not limited to that shown in the drawings and described above; the particular drive system is not germane to the invention. The washing machine 10 may be fluidly connected to a liquid supply 30 through a valve assembly 32 that may be operated to selectively deliver liquid, such as water, to the tub 14 through an outlet 34, which is shown by example as being positioned at one side of the tub 14. The illustrated liquid supply system for the washing machine 10 is provided for exemplary purposes only and is not limited to that shown in the drawings and described above; the particular liquid supply system is not germane to the invention. A control panel 36 enables the operator to control the operation of the washing machine 10.

Figure 2:
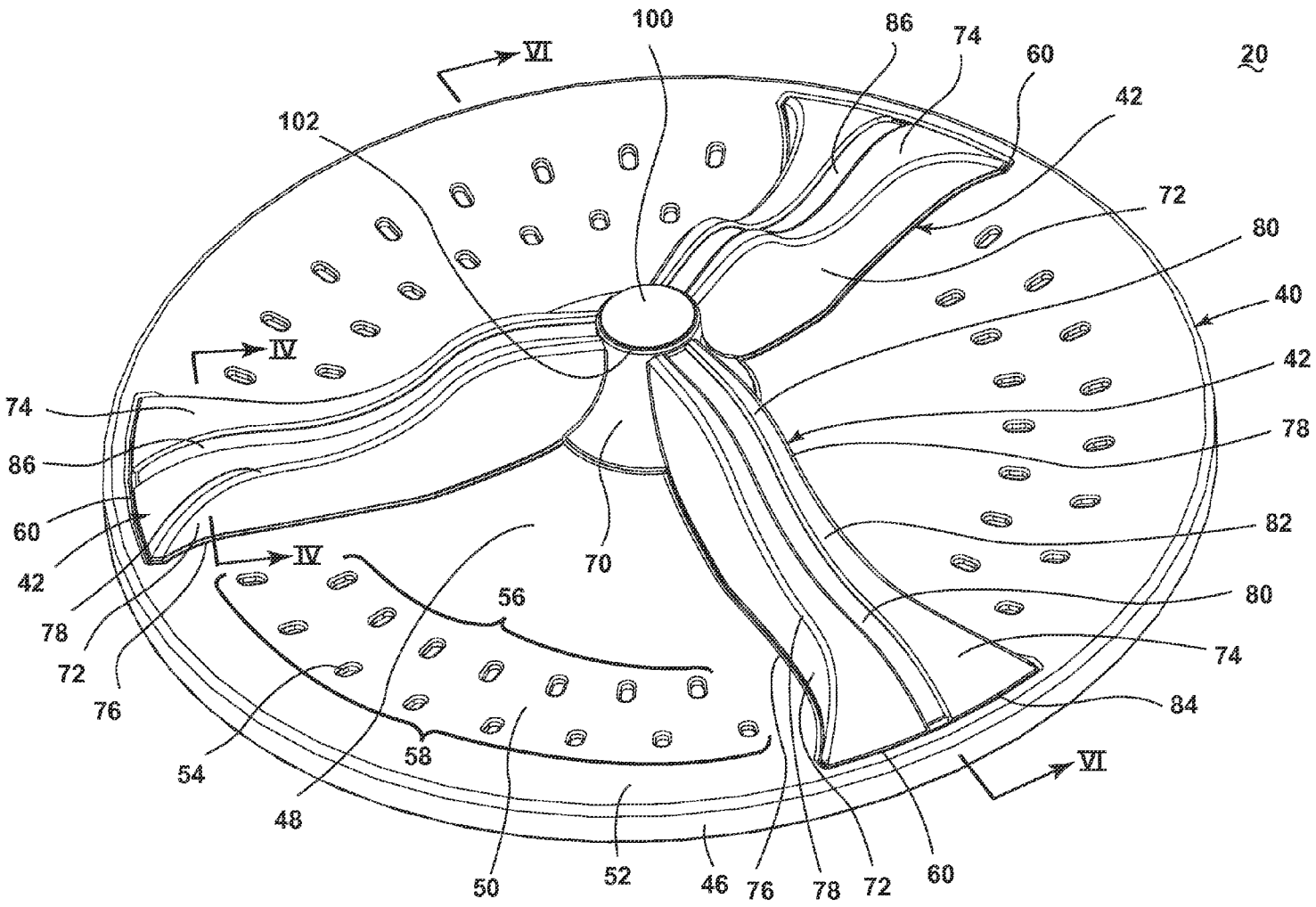
FIG. 2 is a perspective view of the impeller from FIG. 1.
Figure 3:
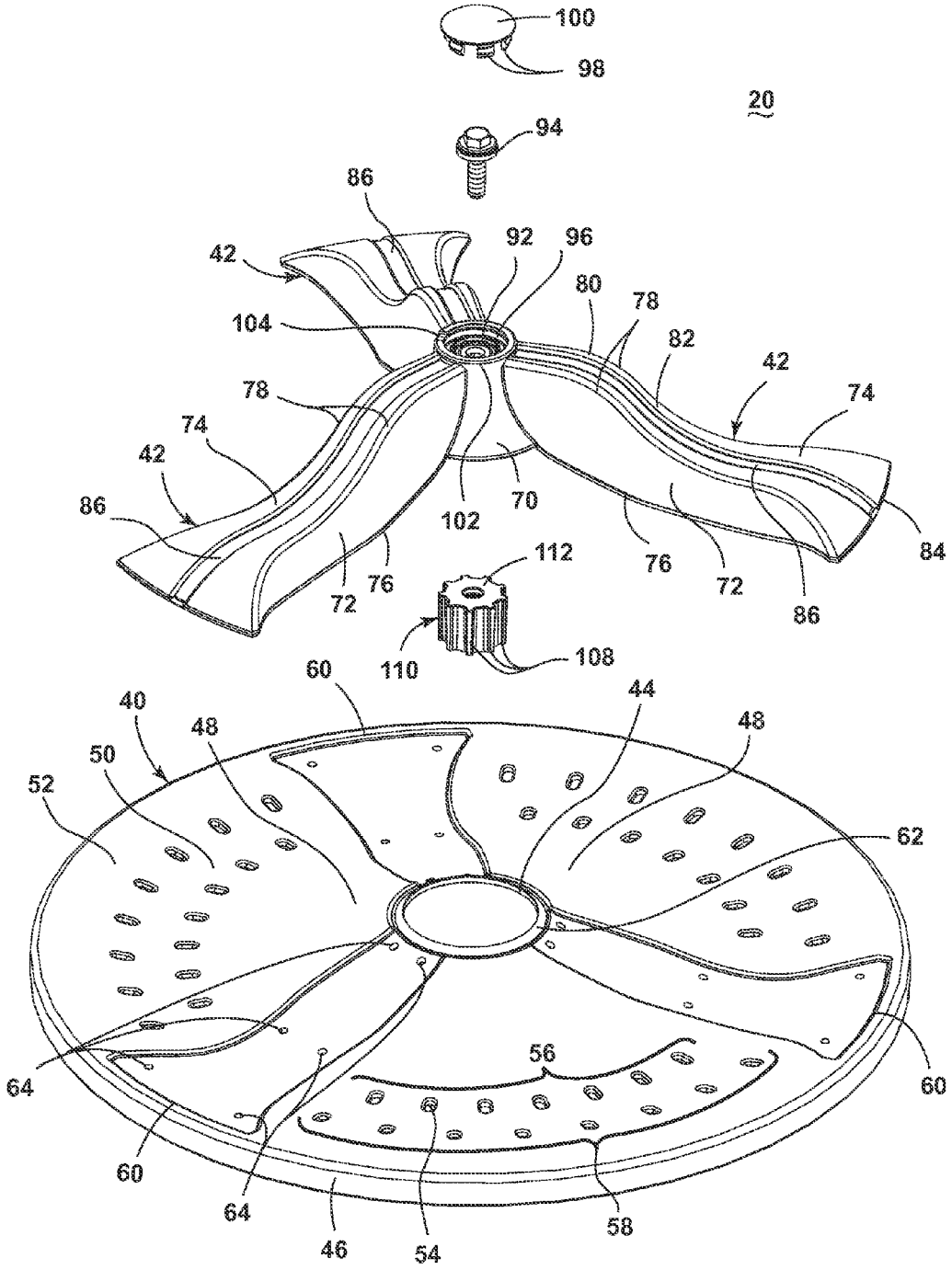
FIG. 3 is a top exploded view of the impeller from FIG. 2.

Referring now to FIG. 2, which is a perspective view of the impeller 20 from FIG. 1, the impeller 20 may include a base 40 with a plurality of vanes or protrusions 42 projecting upward from the base 40. As seen in the top exploded view of FIG. 3, the base 40 extends between a generally circular inner rim 44 and a generally circular outer periphery 46. Moving outward from the inner rim 44, the exemplary base 40 includes an inner region 48 that slopes downward toward a valley 50 before the base 40 slopes upward and becomes generally planar at an outer region 52 terminating at the outer periphery 46.

Several apertures 54 may extend through the base 40, and in the illustrated embodiment, the apertures 54 are arranged in two radially spaced rings 56, 58, wherein the apertures 54 in one of the rings 56 are staggered relative to the apertures 54 in the other of the rings 58. Additionally, the rings 56, 58 of the apertures 54 may be positioned, as an example, at transitions between the inner region 48 and the valley 50 and between the valley 50 and the outer region 52. The apertures 54 may extend around the entire base 40 except for areas where the protrusions 42 are mounted to the base 40.

Figure 4:
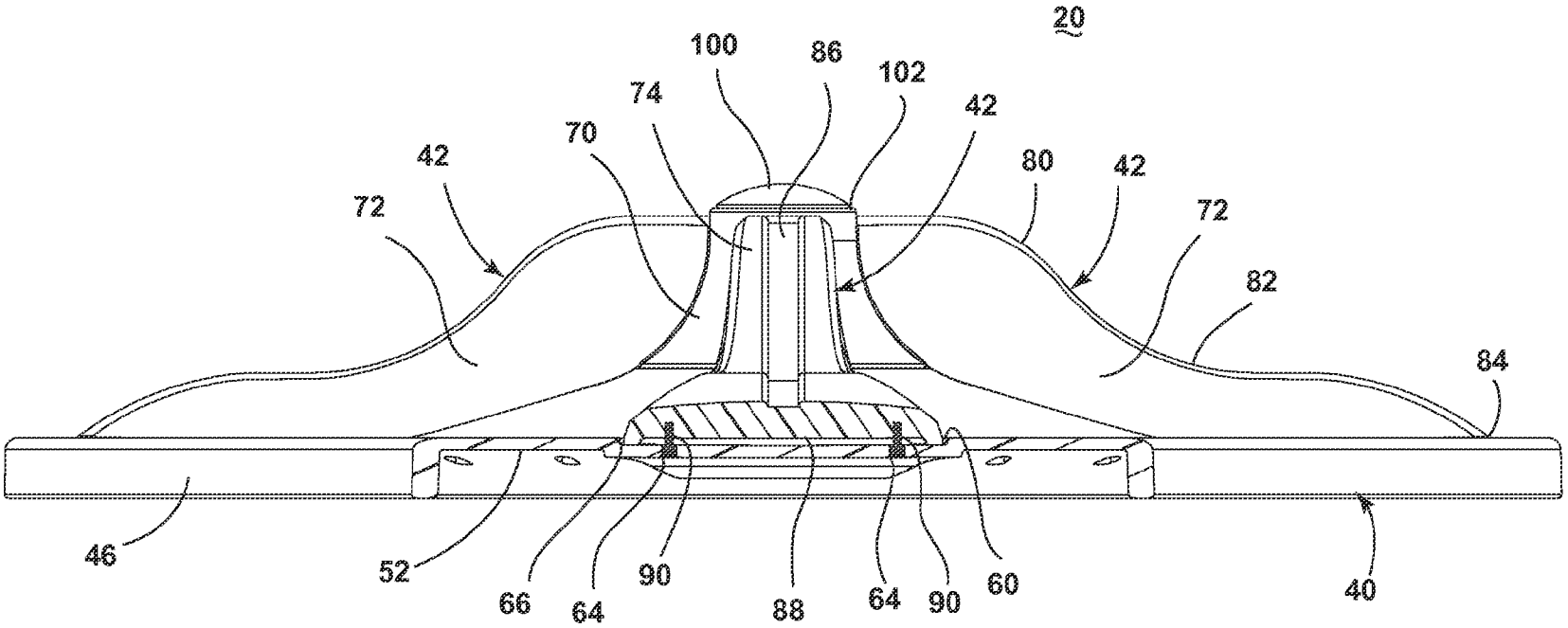
FIG. 4 is a sectional view taken along line IV-IV of FIG. 2.

In the current embodiment, the base 40 includes circumferentially spaced radial depressions 60 that receive the protrusions 42 for mounting the protrusions 42 to the base 40. Further, the depressions 60 may be connected at their inner ends by a ring depression 62 surrounding the inner rim 44. A plurality of openings 64 may extend through the base 40 in the depressions 60 to facilitate mounting of the protrusions 42. The depressions 60 may be shaped in accordance with the configuration of the protrusions 42 and have a depth suitable for concealing an interface or seam 66 between the base 40 and the protrusions 42 so as to prevent laundry items from getting caught in the seam 66, as is best seen in the sectional view of FIG. 4. While the depressions 60 may have any suitable depth, an exemplary depth may be about 1-3 mm.

Referring again to FIG. 3, the vanes or protrusions 42 are joined by a central hub 70 and extend radially outward from the hub 70. Each of the protrusions 42, three of which are shown by example in the illustrated embodiment, may be formed by a pair of opposing side walls 72 joined by an upper wall 74. The side walls 72 are configured such that they generally taper inward toward each other from a bottom edge 76 to a top edge 78 where the side walls 72 meet the upper wall 74. The upper wall 74 defines the profile of the protrusion 42, which extends outward horizontally from the central hub 70 before curving downward at a shoulder 80, then upward at a transition 82, and then downward again before terminating at an outer edge 84. Further, moving radially along the upper wall 74, the upper wall 74 gradually widens along the shoulder 80 and the transition 82 and then rapidly widens and flares outward when the upper wall 74 curves downward to the outer edge 84. Optionally, an elongated groove or linear depression 86 may be formed in the upper wall 74 from where the protrusion 42 meets the hub 70 to the outer edge 84. The side walls 72 may also exhibit curvature, such as the bottom edge 76 flaring outward near the shoulder 80, inward at the transition 82, and outward again toward the outer edge 84, which is evident in the shape of the depressions 60 in the base 40. Referring again to FIG. 4, the protrusions 42 may include a bottom wall 88 spanning the side walls 72, and openings 90 may be formed in the bottom wall 88 in locations corresponding to the openings 64 in the base 40 for receipt of fasteners, such as screws, coupling the protrusions 42 and the base 40. The protrusions 42 may have any suitable configuration and are not intended to be limited to those described above and shown in the illustrations.

Figure 5:
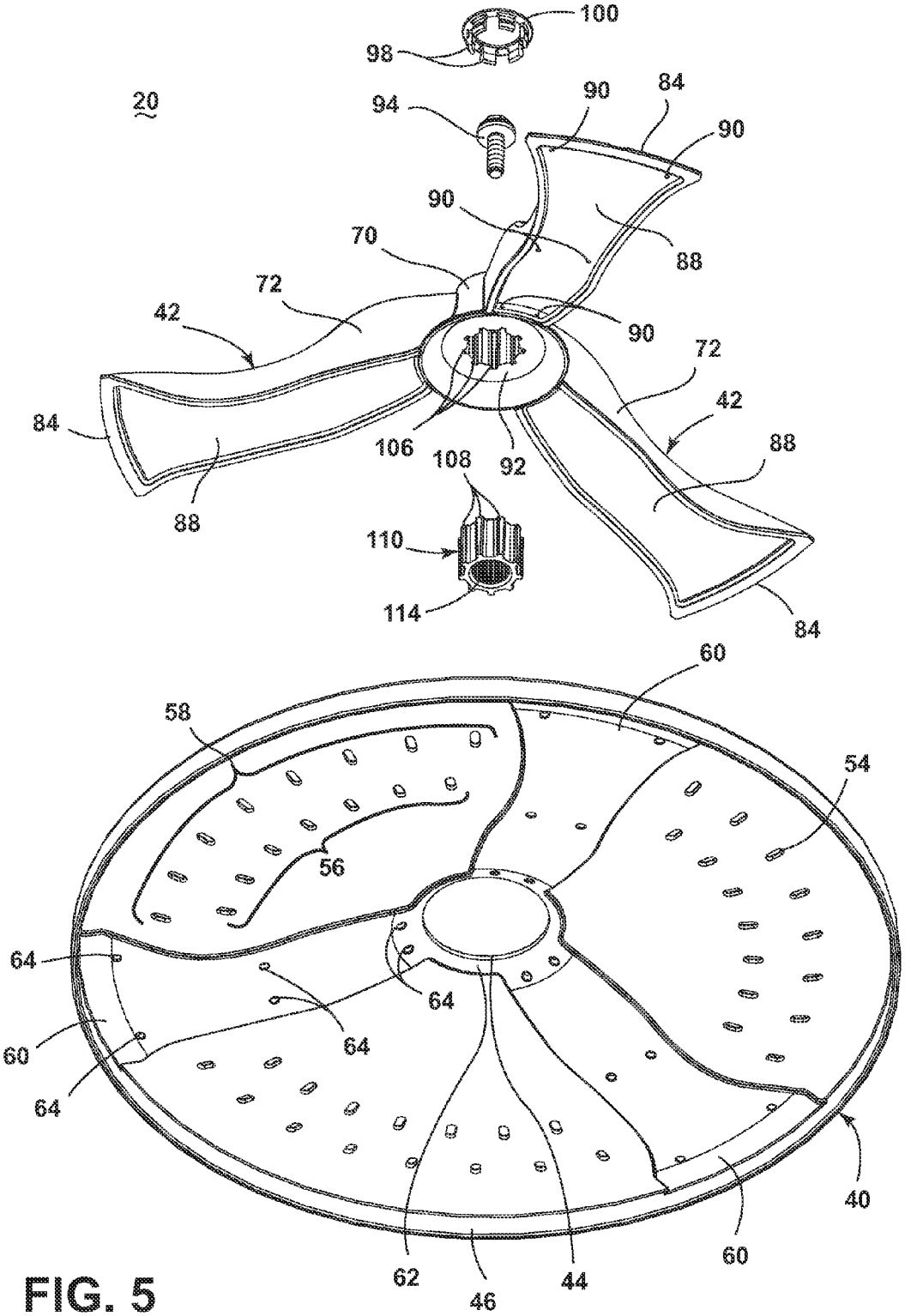
FIG. 5 is a bottom exploded view of the impeller from FIG. 2.
Figure 6:
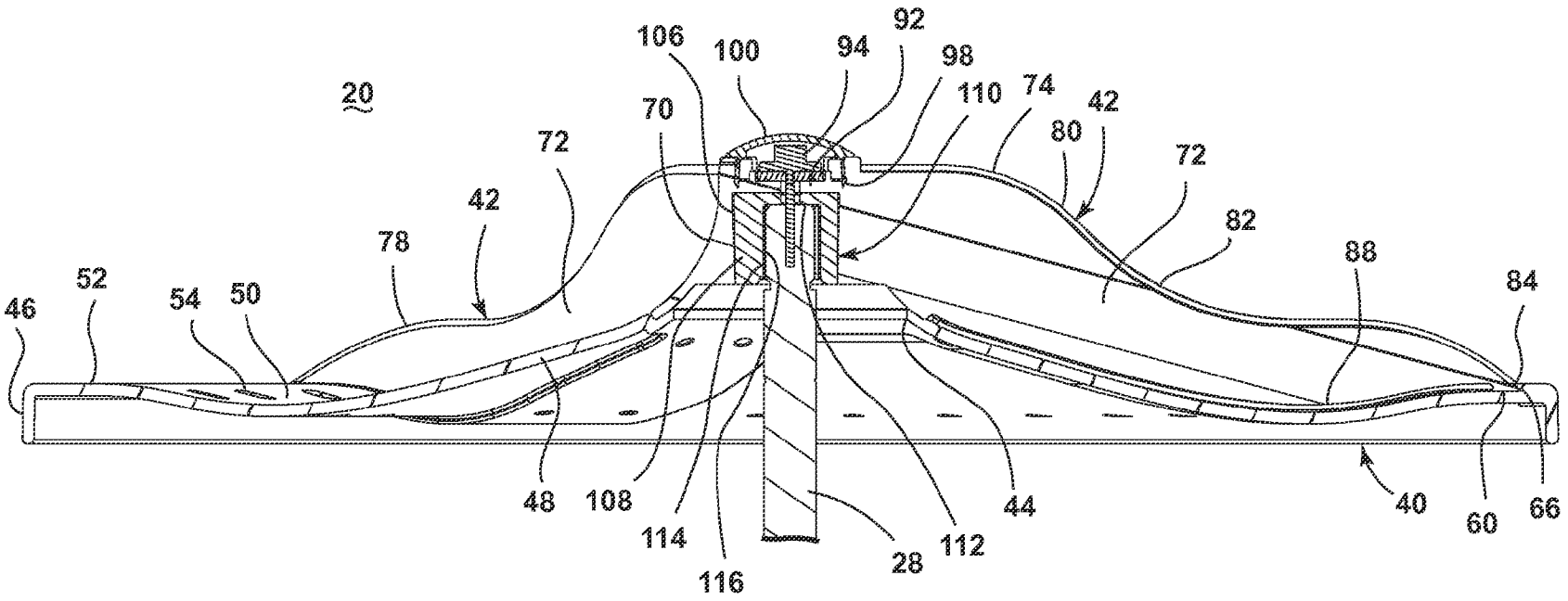
FIG. 6 is a sectional view of the impeller taken along line VI-VI of FIG. 2 with the impeller coupled to a drive shaft.

Referring again to FIG. 3, the central hub 70 joining the protrusions 42 may be generally frustoconical with an arcuate surface, and the ring depression 62 on the base 40 may be configured to receive a portion of the hub 70. The hub 70 may include an annular interior wall 92 oriented generally perpendicular to the axis 18 and forming a seat for a fastener, such as a bolt 94, that extends through the hole defined by the annular wall 92. Above the annular wall 92, a channel 96 may be formed around the inner surface of the hub 70 and configured to receive resilient tangs 98 depending from a cap 100 that abuts an upper surface 102 of the hub 70, which includes a notch 104 to facilitate removal of the cap 100 from the hub 70 if desired. Referring now to FIG. 5, below the annular wall 92, a plurality of generally vertical grooves 106 formed around the inner surface of the hub 70 are configured to slidingly receive mating generally vertical projections 108 formed around the periphery of a drive shaft coupler 110. The drive shaft coupler 110 may be generally cylindrical with an annular upper wall 112 (FIG. 3) and generally vertical grooves 114 formed around the inner surface for mating with splines 116 on the drive shaft 28, as seen in the sectional view of FIG. 6, which shows the impeller 20 coupled to the drive shaft 28 via the drive shaft coupler 110. FIG. 6 also shows the position of the bolt 94 in the hub 70, extending through the hub annular wall 92, the coupler annular wall 112, and into the drive shaft 28, with the coupler annular wall 112 sandwiched between the hub annular wall 92 and the drive shaft 28. As a result of this arrangement, the drive shaft coupler 110 not only couples the impeller 20 to the drive shaft 28 but also transfers rotation of the drive shaft 28 to the impeller 20.

The base 40 and the protrusions 42 may be made of differing materials. For example, the base 40 may be made of a metal, such as stainless steel. Other exemplary metals include, for example, aluminum, and porcelain coated steel. The protrusions 42 may be made of a polymer, such as a plastic. Exemplary plastics include, but are not limited to, polypropylene (PP), filled polypropylene (PP), polyvinyl chloride (PVC), acrylonitrile butadiene styrene (ABS), and Santoprene®. Employing differing materials for this "hybrid" laundry mover enables the base 40 to be formed by metal, which is a desirable material for a laundry mover, while the protrusions 42 are not subjected to limitations, such as cost and ease of manufacturing, associated with metals. By making the protrusions 42 from a plastic, the protrusions 42 may have a desired configuration to achieve a preferred movement or behavior of the laundry and the liquid that may not be feasible or economical with metals.

As seen in FIG. 2, the impeller 20 has an upper surface, which is the surface that is visible to a user when looking into the washing machine 10 or, put another way, looking down on the impeller 20 from above. The upper surface may be formed by both the base 40 and the protrusions 42. By example, the upper surface of the impeller 20 in the illustrated embodiment is formed by the upper surface of the protrusions 42, including the upper surface of the hub 70 joining the protrusions 42 and the cap 100, and the portions of the upper surface of the base 40 not covered by the protrusions 42. Because the upper surface of the impeller 20 is formed by both the upper surfaces of the protrusions 42 and portions of the upper surface of the base 40 that are made of differing materials, the upper surface of the impeller 20 is formed by differing materials, such as by a metal and a plastic.

Figure 7:
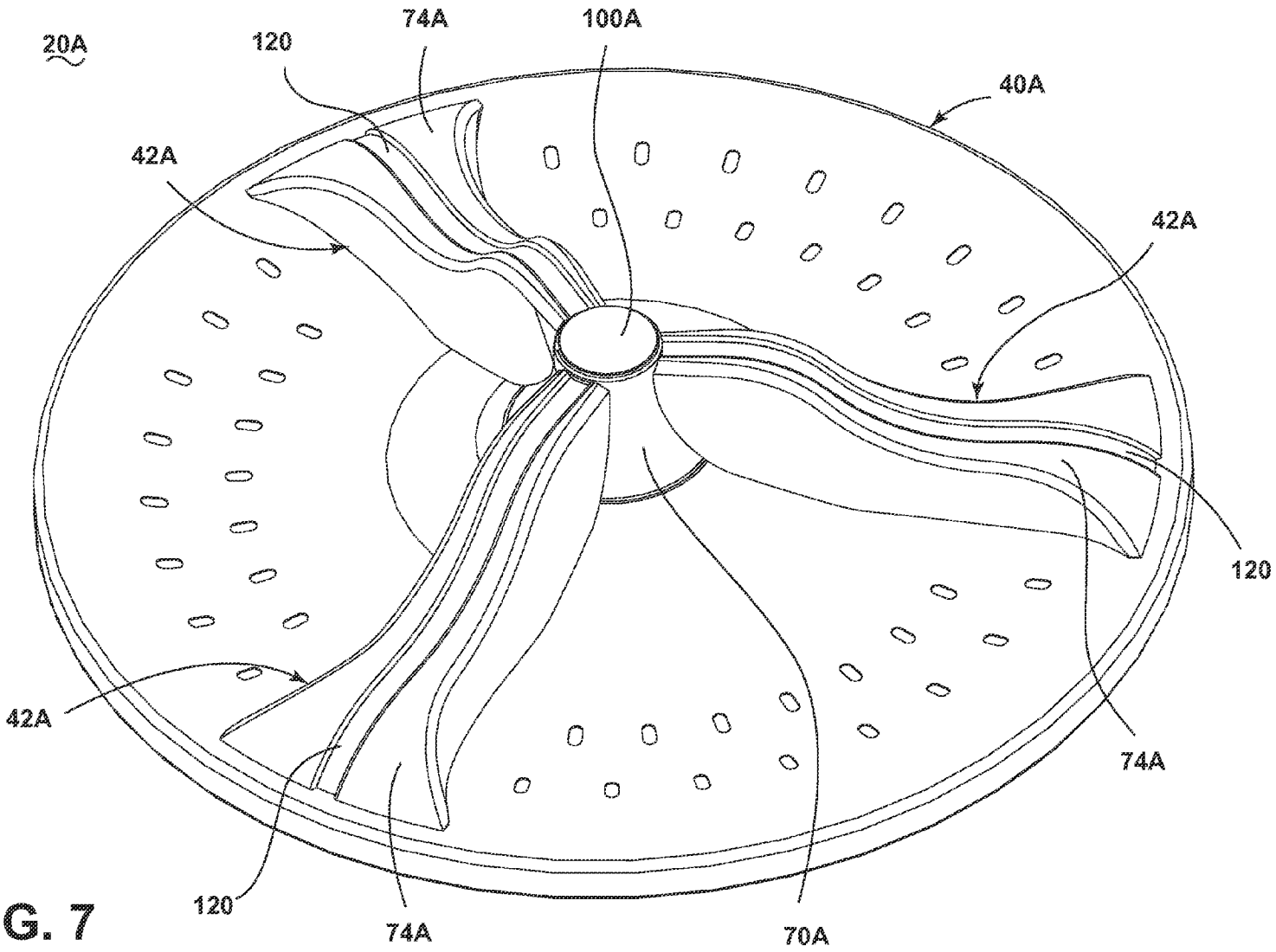
FIG. 7 is a perspective view of an impeller according to another embodiment.

FIG. 7 is a perspective view of an impeller 20A according to another embodiment. Elements similar to those of previous embodiments are identified with the same reference numeral bearing a letter "A." The impeller 20A of FIG. 7 is substantially identical to that of FIGS. 1-6, and the differences are explained below.

Figure 8:
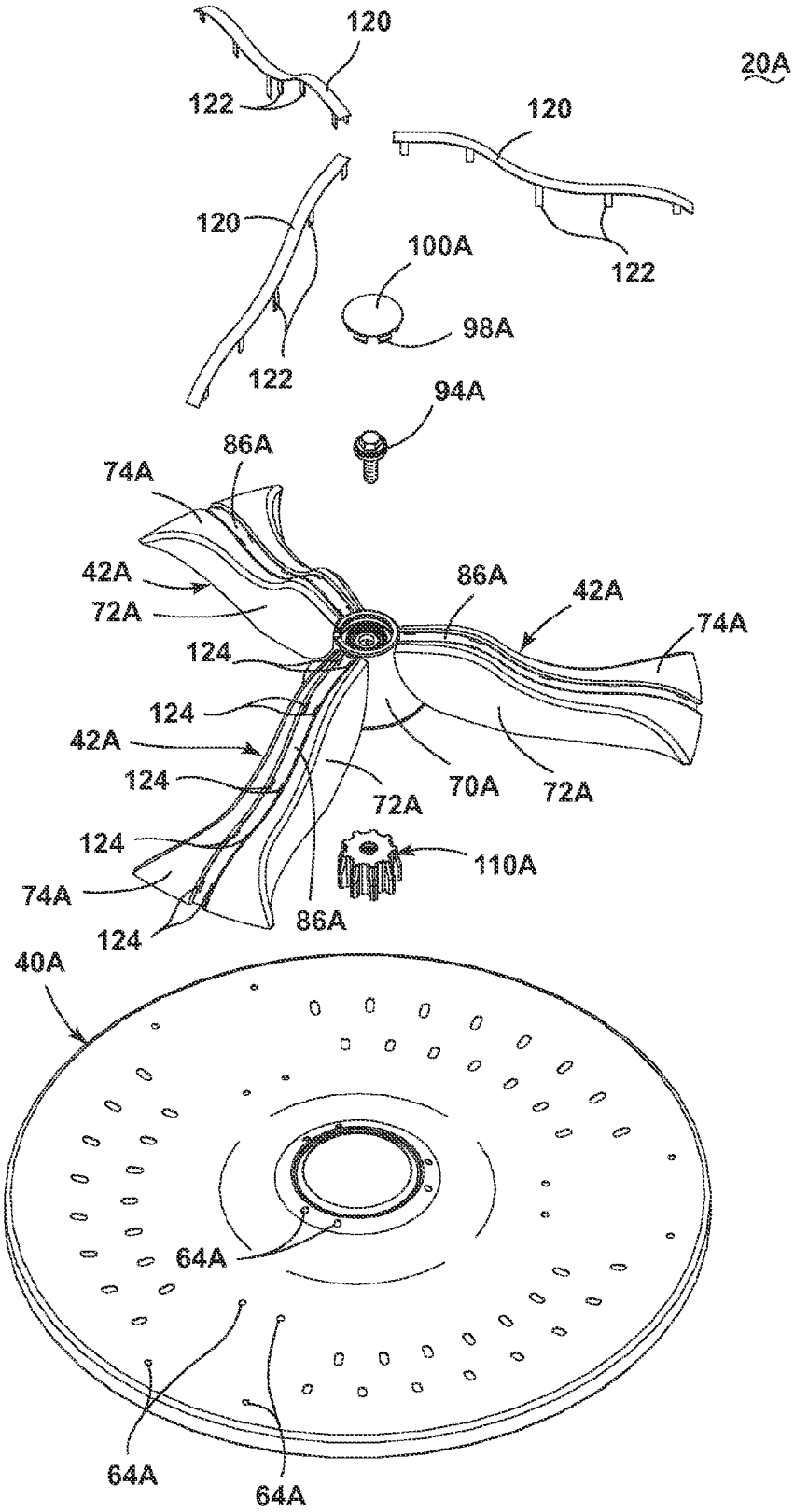
FIG. 8 is a top exploded view of the impeller from FIG. 6.

Each of the protrusions 42A of the impeller 20A may include a body or strip 120 shaped in accordance with and received within the linear depression 86A, as seen in exploded view of FIG. 8. The strip 120 may be made of the same material as the base 40A, such as a metal, or by another material. A plurality of fingers 122, also known as toy tabs, may depend from the strip 120 for receipt through a plurality of corresponding apertures or slits 124 in the linear depression 86A. The portion of the fingers 122 below the slits 124 may be bent, crimped, or otherwise deformed to secure the strip 120 in position on the protrusion 42A. The strips 120 may reside entirely within the linear depression 86A or may be configured such that they are coincident with the upper wall 74A to effectively form a unitary upper surface; in either configuration, the strips 120 are positioned so as to not interfere with the laundry.

Figure 9:
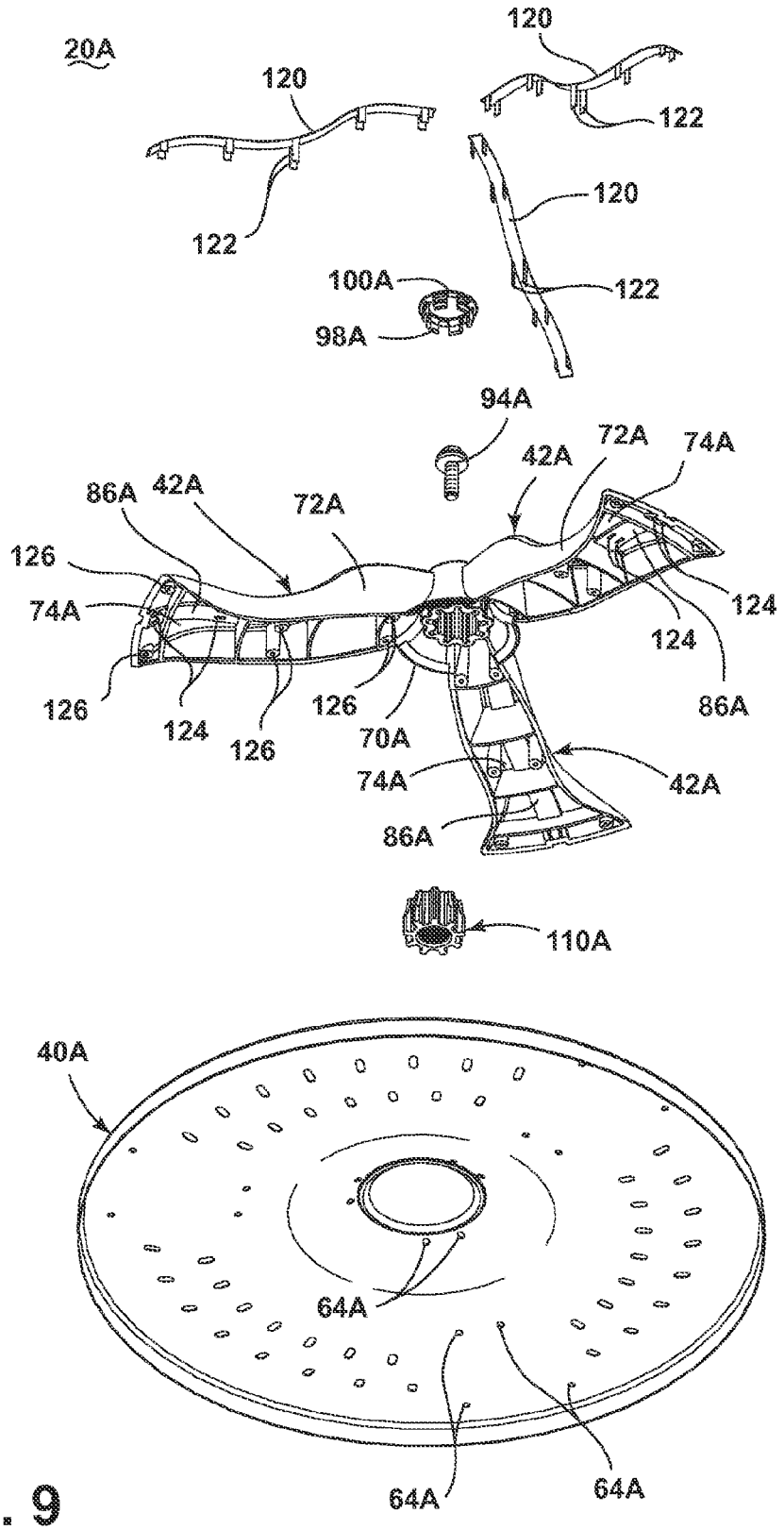
FIG. 9 is a bottom exploded view of the impeller from FIG. 6.

With continued reference to FIG. 8, the base 40A may forego the depressions 60 from the embodiment of FIGS. 1-6 but may include the openings 64A that align with posts 126 depending from the upper wall 74A of the protrusions 42A, as seen in the bottom exploded view of FIG. 9. Mechanical fasteners, such as screws, may be inserted through the openings 64A in the base 40A and into the posts 126 of the protrusions 42A to mount the protrusions 42A to the base 40A. The open bottom of the protrusions 42A (i.e., lacking the bottom wall 88 of the previous embodiment) provides access to the interior of the protrusions 42A for coupling the strips 120 to the upper wall 74A. While the depressions 60 from the previous embodiment have been omitted, it is contemplated that similar depressions may be used with the present structure for mounting the protrusions 42A to the base 40A.

Figure 10:
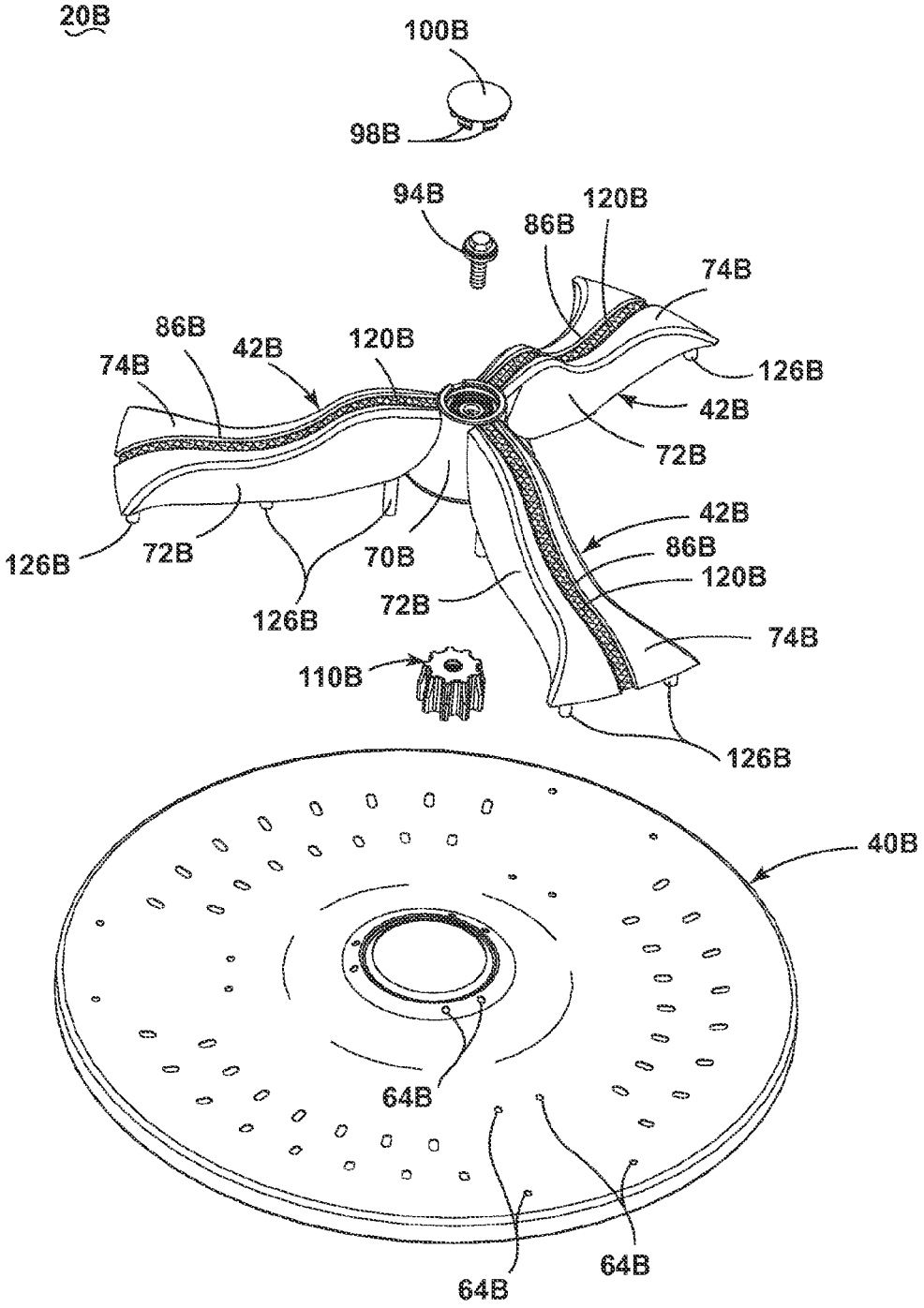
FIG. 10 is an exploded view of an impeller according to another embodiment.

FIG. 10 is an exploded view of an impeller 20B according to another embodiment. Elements similar to those of previous embodiments are identified with the same reference numeral bearing a letter "B." The impeller 20B of FIG. 10 is substantially identical to that of FIGS. 1-6, and the differences are explained below.

Each of the protrusions 42B of the impeller 20B may include a strip 120B integrally formed within the linear depression 86B. The strip 120B may be made of the same material as the protrusions 42B, such as a plastic, or by another material. When the strip 120B is made of a plastic, the strip 120B may be overmolded onto the protrusion 42B, for example, and may be a color different than the color of the rest of the protrusion 42B for visual differentiation. The strips 120B may reside entirely within the linear depression 86B or may be configured such that they are coincident with the upper wall 74B to effectively form a unitary upper surface; in either configuration, the strips 120B are positioned so as to not interfere with the laundry.

With continued reference to FIG. 10, the base 40B may forego the depressions 60 from the embodiment of FIGS. 1-6 but may include the openings 64B that align with posts 126B depending from the upper wall 74B of the protrusions 42B. The posts 126B may be inserted through the openings 64B in the base 40B and heat staked or otherwise deformed to couple the protrusions 42B to the base 40B. The protrusions 42B are illustrated as having an open bottom but may include a bottom wall similar to the bottom wall 88 of the embodiment of FIGS. 1-6, if desired. Also, while the depressions 60 from the embodiment of FIGS. 1-6 have been omitted, it is contemplated that similar depressions may be used with the present structure for mounting the protrusions 42B to the base 40B.

Figure 11:
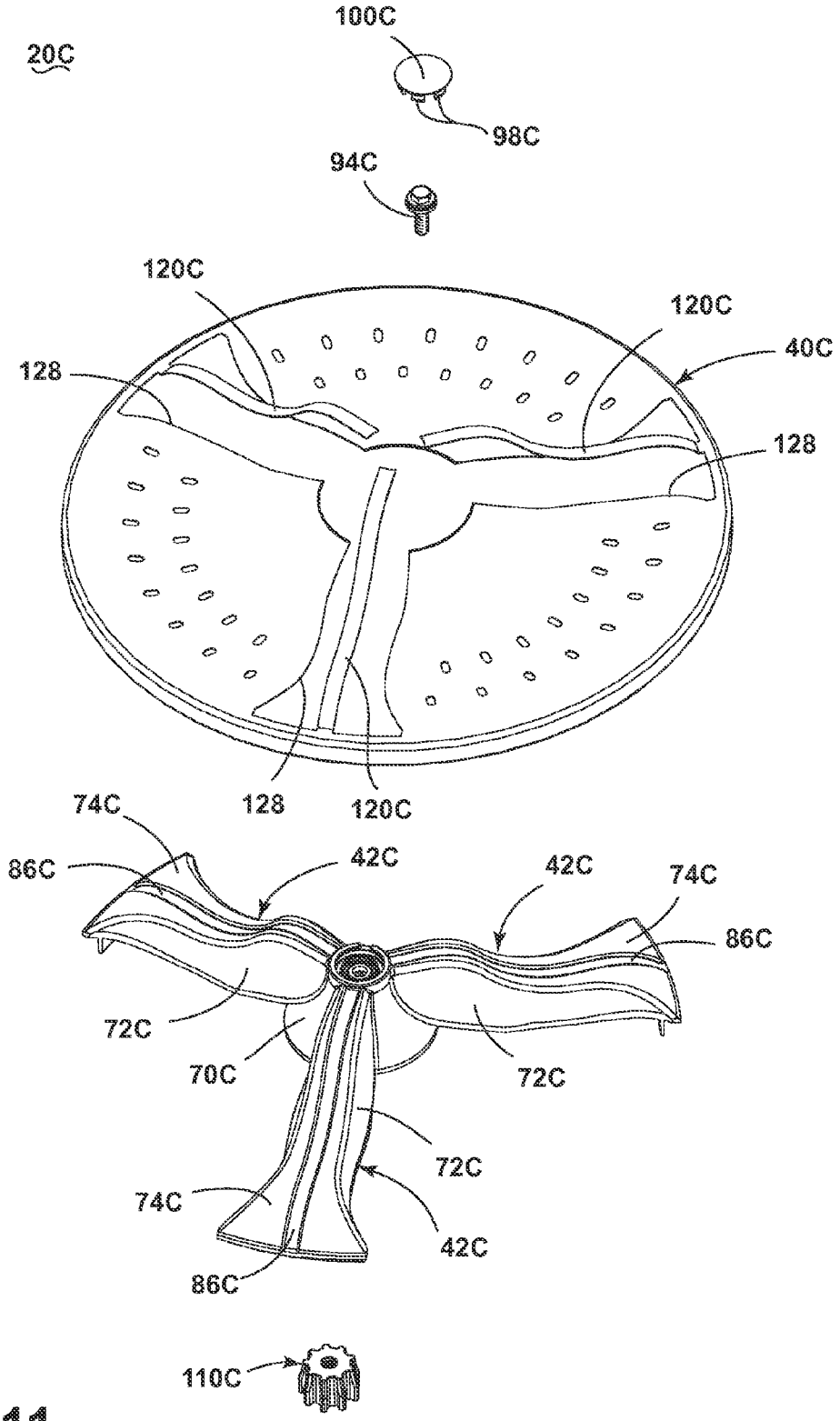
FIG. 11 is an exploded view of an impeller according to another embodiment.

FIG. 11 is an exploded view of an impeller 20C according to another embodiment. Elements similar to those of previous embodiments are identified with the same reference numeral bearing a letter "C." The impeller 20C of FIG. 11 is substantially identical to that of FIGS. 1-6, and the differences are explained below.

At the same locations as the depressions 60 from the embodiment of FIGS. 1-6, the base 42C may have an opening 128 shaped and sized to receive the protrusions 42C and the hub 70C joining the protrusions 42C. Additionally, the base 40C may include strips 120C integrally formed with and extending upward from the base 40C and over the opening 128 such that each of the strips 120C aligns with one of the corresponding linear depressions 86C on the protrusions 42C. The protrusions 42C may be inserted through the opening 128 from below the base 40C into position with the strips 120C received by the linear depressions 86C. As with the strips 120B of the embodiment of FIGS. 7-9, the strips 120C may be made of the same material as the base 40C, such as a metal, or by another material and may reside entirely within the linear depression 86C or may be configured such that they are coincident with the upper wall 74C to effectively form a unitary upper surface.

Figure 12:
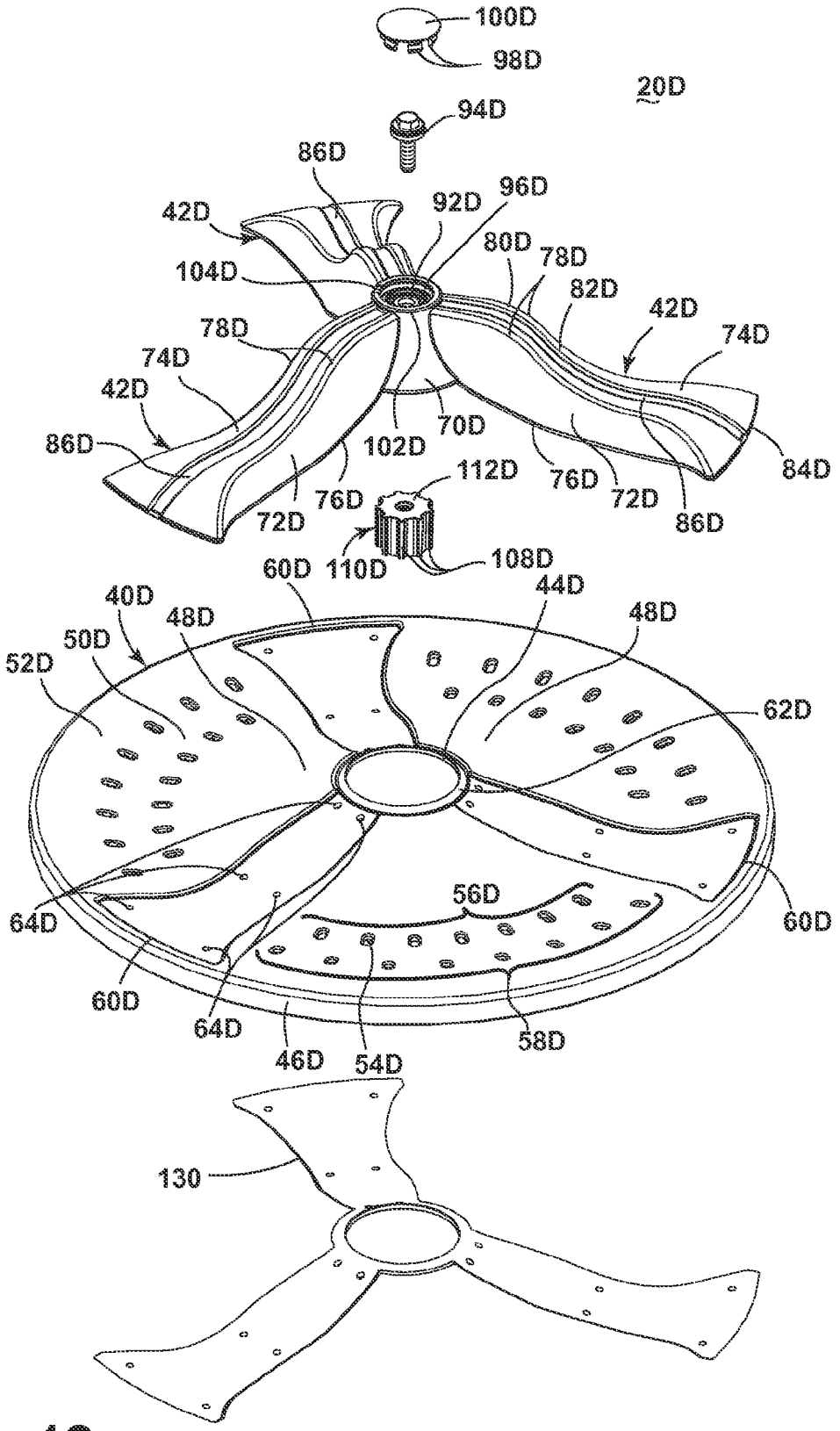
FIG. 12 is an exploded view of an impeller according to another embodiment.

FIG. 12 is a perspective view of an impeller 20D according to another embodiment. Elements similar to those of previous embodiments are identified with the same reference numeral bearing a letter "D." The impeller 20D of FIG. 12 is substantially identical to that of FIGS. 1-6, with the primary difference related to the impeller 20D including a backing plate 130 located below the base 40D, and the protrusions 42D are mounted to the backing plate 130 with fasteners, such as screws, with the base 40D positioned between the protrusions 42D and the backing plate 130.

As mentioned above, the impeller 20 of all embodiments may be made from more than one material. In the illustrated embodiments, the base 40 may be made from metal, while the protrusions may be made from plastic to form a hybrid upper surface for the impeller. It is within the scope of the invention for the impeller to have parts other than those described here made of the differing materials. Additionally, the impeller may have a configuration other than that shown herein by example, such as a differently shaped base, differently shaped protrusions or vanes, different numbers and locations of protrusions or vanes. Further, the hybrid laundry mover need not be an impeller, but may be an agitator, a combination agitator and impeller, or other type of laundry mover. The hybrid upper surface of the laundry mover may be formed of more than two materials. For example, the projections may be made of two types of materials, with the base made of a third material such that three different materials form the laundry mover upper surface. Furthermore, various methods of mounting the protrusions 42 to the base 40 are described above, and another exemplary method of joining the two components is to mold the protrusions 42 onto the base 40 with a comolding process, such as insert molding or overmolding. Additionally, the strips 120 may be an optional feature, and it is contemplated that any of the embodiments that include the strips 120 may omit them, and the strips 120 may be of any size or shape and are not limited to the examples shown in the figures and described herein.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure. The primary differences among the exemplary embodiments relate to the structure for mounting the protrusions 42 to the base 40 and to the presence or type of the strips 120 on the protrusions 42, and these features may be combined in any suitable manner to modify the above described embodiments and create other embodiments. As examples, the depressions 60 of FIGS. 1-6 can be incorporated into the embodiment of FIGS. 7-9 having the strips 120, or the posts 126B from FIG. 10 could be employed by the impeller 20 of FIGS. 1-6 to mount the protrusions 42 to the base 40.

While the invention has been specifically described in connection with certain specific embodiments thereof, it is to be understood that this is by way of illustration and not of limitation, and the scope of the appended claims should be construed as broadly as the prior art will permit.

What is claimed is:

1. A laundry treating appliance configured to treat laundry according to an automatic cycle of operation, the appliance comprising:

a treating chamber for receiving laundry for treatment; and an impeller mounted within the treating chamber for rotation about a rotation axis and comprising:

a base having a base upper surface formed of a first material; and a central hub joining a plurality of protrusions extending outward from the central hub to an outer edge and each having a protrusion upper surface formed of a second material different from the first material wherein the protrusion upper surfaces flare outwardly at the outer edge;

wherein the central hub with the plurality of protrusions is mounted to the base upper surface via a fastening mechanism and where the upper surfaces of the base and the protrusions collectively form an upper surface of the impeller such that the impeller upper surface is at least partially formed of the differing first and second materials.

2. The laundry treating appliance of claim 1 wherein the first material is a metal.

3. The laundry treating appliance of claim 2 wherein the second material is a polymer.

4. The laundry treating appliance of claim 3 wherein the first material is stainless steel, and the second material is polypropylene.

5. The laundry treating appliance of claim 1 wherein the protrusion upper surfaces extend outward horizontally from the central hub, downward at a shoulder, upward at a transition, and downward again adjacent the outer edge.

6. The laundry treating appliance of claim 1 wherein the base comprises depressions shaped to receive the protrusions with a portion of the protrusions sitting in the corresponding depressions hiding a seam between a bottom edge of the protrusions and the base.

7. The laundry treating appliance of claim 1 wherein the impeller further comprises a backing plate underneath the base, and the protrusions are mounted to the backing plate with the base located in between the protrusions and the backing plate.

8. The laundry treating appliance of claim 1 wherein the fastening mechanism comprises portions of the protrusions heat staked to the base.

9. The laundry treating appliance of claim 1 wherein the base has openings shaped to receive the protrusions, and the protrusions extend through the openings.

10. The laundry treating appliance of claim 9 wherein the protrusions are molded onto the base.

11. The laundry treating appliance of claim 1 wherein the central hub is frustoconical with an arcuate surface.

12. The laundry treating appliance of claim 11 wherein the impeller further comprises a drive shaft coupler located in the central hub and having a grooved interior surface that mates with a splined drive shaft for the rotation of the impeller.

13. The laundry treating appliance of claim 1 wherein the plurality of protrusions each include a depressed region formed on the protrusion upper surface for receiving a body made of the first material.

14. The laundry treating appliance of claim 13 wherein the body comprises an elongated strip mounted within the depressed region.

15. The laundry treating appliance of claim 14 wherein the elongated strip is mounted to one of the plurality of protrusions with tabs received within corresponding apertures formed in the protrusions.

16. The laundry treating appliance of claim 14 wherein the elongated strip is integrally formed with the base.

17. The laundry treating appliance of claim 1 wherein the second material is a polymer having a first color, and the protrusions each include a depressed region formed on the upper surface into which a polymer having a second color different than the first color is overmolded.

18. The laundry treating appliance of claim 17 wherein the polymer for the protrusions and the polymer overmolded into the depressed regions are the same type of polymer.

19. The laundry treating appliance of claim 1 wherein the base further comprises a non-metallic lower part operably coupled to an underside of the base upper surface.

* * * * *